US009869285B2

(12) United States Patent
Wanner et al.

(10) Patent No.: US 9,869,285 B2
(45) Date of Patent: Jan. 16, 2018

(54) CIRCUIT CONFIGURATION FOR STARTING AN INTERNAL COMBUSTION ENGINE AND METHOD OF A STARTER CONTROL

(75) Inventors: Hartmut Wanner, Herrenberg-Oberjesingen (DE); Uwe Daurer, Kornwestheim (DE)

(73) Assignee: Robert Bosch GMBH, Stuttgart (DE)

( * ) Notice: Subject to any disclaimer, the term of this patent is extended or adjusted under 35 U.S.C. 154(b) by 705 days.

(21) Appl. No.: 13/138,602

(22) PCT Filed: Mar. 2, 2010

(86) PCT No.: PCT/EP2010/052604
§ 371 (c)(1),
(2), (4) Date: Nov. 17, 2011

(87) PCT Pub. No.: WO2010/105901
PCT Pub. Date: Sep. 23, 2010

(65) Prior Publication Data

US 2012/0086219 A1 Apr. 12, 2012

(30) Foreign Application Priority Data

Mar. 20, 2009 (DE) ..... 10 2009 001 694

(51) Int. Cl.
*F02N 11/08* (2006.01)
*F02N 11/00* (2006.01)
(Continued)

(52) U.S. Cl.
CPC ..... *F02N 11/00* (2013.01); *F02N 11/006* (2013.01); *F02N 15/067* (2013.01); *F02N 15/10* (2013.01); *F02N 11/0851* (2013.01)

(58) Field of Classification Search
CPC ..... F02N 11/00; F02N 15/067; F02N 15/10; F02N 11/006; F02N 11/0851
(Continued)

(56) References Cited

U.S. PATENT DOCUMENTS 5,095,864 A 3/1992 Bolenz et al.
5,325,827 A * 7/1994 Fasola ..... 123/179.3
(Continued)

FOREIGN PATENT DOCUMENTS

CN 101007523 8/2007
CN 101331315 12/2008
(Continued)

OTHER PUBLICATIONS

International Search Report, PCT International Patent Application No. PCT/EP2010/052604, dated Jun. 8, 2010.

*Primary Examiner* — Viet Nguyen
(74) *Attorney, Agent, or Firm* — Norton Rose Fulbright US LLP; Gerard Messina

(57) ABSTRACT

A circuit configuration is described, for starting an internal combustion engine, using at least one starter, which includes a starter motor, an engaging relay, a switching relay and a control relay, the control relay being able to be controlled by an ignition switch, the engaging relay being able to be controlled by the control relay and a current path of the starter motor being able to be switched using the switching relay. In order for the starter, for starting an internal combustion engine, to operate more accurately, and thus to achieve a longer service life, the switching relay is able to be controlled as a function of the occurrence of a specified event, at least in the switching-off process. This has the advantage that the switching relay is able to interrupt a current path from the starter motor earlier in time, especially a main current path, so that energizing in the reverse direction is avoided. Consequently, the switching relay is able to release the current path of the starter motor specified in such a way that in the switching-off process, during the disengaging of a starter pinion, pinion bounce is clearly reduced, or even eliminated. In the switching-off process of
(Continued)

the starter, a motion of the starter pinion back in the direction towards the ring gear, after the disengagement, is avoided.

13 Claims, 5 Drawing Sheets

(51) Int. Cl.
*F02N 15/06* (2006.01)
*F02N 15/10* (2006.01)

(58) Field of Classification Search
USPC ..... 290/38 R, 38 C, 36 R, 27
See application file for complete search history.

(56) References Cited

U.S. PATENT DOCUMENTS

| | | | | |
|---|---|---|---|---|
| 5,731,638 | A * | 3/1998 | Niimi | 290/38 R |
| 7,216,617 | B2 * | 5/2007 | Tanaka et al. | 123/179.3 |
| 7,821,146 | B2 | 10/2010 | Wanner | |
| 2008/0283012 | A1 * | 11/2008 | Wanner | 123/179.25 |
| 2010/0213713 | A1 | 8/2010 | Biessenberger et al. | |

FOREIGN PATENT DOCUMENTS

| | | |
|---|---|---|
| DE | 3241079 | 7/1983 |
| DE | 10046987 | 4/2002 |
| DE | 102005006248 | 8/2006 |
| GB | 2114827 | 8/1983 |
| JP | 48-87420 | 1/1947 |
| JP | 49-88152 | 11/1947 |
| JP | 32-1305 | 3/1957 |
| JP | 4-262067 | 9/1992 |
| JP | 6-2636 | 1/1994 |
| JP | 11-190267 | 7/1999 |
| JP | 2003-83212 | 3/2003 |
| WO | WO 89/12164 | 12/1989 |
| WO | WO 09/07465 | 1/2009 |

* cited by examiner

CIRCUIT CONFIGURATION FOR STARTING AN INTERNAL COMBUSTION ENGINE AND METHOD OF A STARTER CONTROL

FIELD OF THE INVENTION

The present invention relates to a circuit configuration for starting an internal combustion engine having at least one starter which includes a starter motor, an engaging relay, a switching relay and a control relay, the control relay being able to be controlled by an ignition switch, and a current path from the starter motor being able to be switched using the switching relay.

The present invention also relates to a method of a starter control, particularly a circuit configuration of a starter, preferably of starters switchable in parallel for starting an internal combustion engine, the starter being developed to have a starter motor, a control relay, an engaging relay and a switching relay, the engaging relay being controlled by the control relay and the switching relay being controlled by the engaging relay.

BACKGROUND INFORMATION

Some conventional starting devices are situated and switched in parallel to start an internal combustion engine. Such an internal combustion engine usually has very large dimensions and a displacement of several 10's or 100's of liters.

In response to the use of parallel starting devices on one internal combustion engine, the simultaneous switching of the main current of the participating starter motors is important, since the simultaneous switching of the individual starter motors protects against overloading. In order to achieve this response which protects against overloading, the functions of engaging and switching are each implemented by a single relay. These two functions that are usually unified, that are carried out by an engaging relay, such as engaging a starter pinion and the switching on of the current for the starter motor are thus divided up. By separating the two functions, it is possible to provide an electrical circuit configuration in such a way that the starting device switches in the main current for the starter motor only when all engaging processes in all starting devices have been carried out. In this context, the engaging processes may have different engaging times, since the tooth-on-tooth position of a starter pinion in the ring gear requires a longer engaging process than a tooth-gap setting. In order to compensate for the time difference of at least two closing processes, the main current for the at least two starter motors is released simultaneously only when all closing processes have been carried out. Thus, for the engaging, succeeding relays are switched and closed one after another. An ignition current path is controlled in a control relay which releases an engaging relay. When there is current in all engaging relays, at least one switching relay is switched through which releases the main current for each starter motor. Switching off the starters takes place in the same sequence. The supplying of current to the control relay, then the engaging relay and last the switching relay is interrupted, so that the appropriate current paths are opened.

German Patent Application No. DE 10 2005 006 248 A1 describes a starting system for starting an internal combustion engine having several starters connected in parallel. In order to improve the switching certainty using the lowest possible wiring effort, the concatenation of the function "engaging" and "switching main current", which is implemented by a relay, is divided to two relays, each having a separate function in each individual starter.

It is an object of the present invention further to develop a circuit configuration in such a way that at least one starter for starting an internal combustion engine works more exactly, and consequently achieves a longer service life.

SUMMARY

In the switching-off process of the starter, a motion of the starter pinion back in the direction of the ring gear takes place after disengaging, since because of a still closed main contact of the switching relay, the engaging relay has a reverse current applied to it.

In accordance with an example embodiment of the present invention, the switching relay is able to be controlled as a function of the occurrence of a specified event, at least in the switching-off process. This has the advantage that the switching relay is able to interrupt a current path of the starting motor earlier in time, especially a main current path, so that energizing in the reverse direction is avoided.

Consequently, the switching relay is able to release the current path of the starter motor specified in such a way that in the switching-off process, during the disengaging of a starter pinion, pinion bounce is clearly reduced, or even eliminated.

Thus, in accordance with an example embodiment of the present invention, when switching off the at least one starter, the starter motor is switched off earlier in time than in the conventional system, in order to avoid pinion bounce. Pinion bounce takes place if, after disengaging, the starter pinion moves again in the direction towards the ring gear of the internal combustion engine, and because of that, wear is created on the ring gear and/or the starter pinion. Besides that, sparks may form, which has to be avoided to prevent greater damage to the starter and/or the internal combustion engine.

According to a further preferred specific embodiment, the specified event is established in that the circuit configuration is developed to be electromechanical. Consequently, the occurrence of the specified event during the switching-off process is implemented to be stable and switching reliably, and takes place as simply and cost-effectively as possible.

According to one particular specific embodiment, the switching relay is advantageously situated in the current path of the engaging relay that is switchable by the control relay. Consequently, the switching relay is switched off at the same time as the engaging relay. The switching relay is not switched off by the engaging relay, as was described in the related art above. Consequently, the point in time for switching off the current path for the starter motor is clearly shifted further forward, so that pinion bounce may be avoided or clearly reduced in intensity. Abrasive behavior is reduced, and this increases the service life of a starter.

According to one further preferred specific embodiment, the switching relay has two control switches. The first control switch is the engaging relay in the engaging process, which simultaneously closes a switch, when the maximum engaging depth is achieved during engaging, by which the switching relay becomes able to be energized. A second control switch is provided to control the switching relay at a certain relationship in the disengaging process or the switching-off process of the engaging relay. According to one simple circuit, the second control switch is the control relay. Both in the engaging and the disengaging process, the control relay is operated as the second control switch, indeed before the first control switch.

The switching relay and the control relay as well as the engaging relay are thus linked to one another as electromechanical switches. The control relay switches both a current path of the engaging relay and a current path of the switching relay. In addition, the engaging relay switches a current path of the switching relay.

According to one alternative specific embodiment, the switching system is developed as an electronic control having electronic power switches. This has the advantage that the switching times, particularly of the switching relay, is able to be adapted even more individually, so that the intensity of pinion bounces is able to be suppressed better.

In order to start internal combustion engines having greater displacements, a plurality of starters is connected and situated in parallel. The starters for switching the main current for the respective starter motor in the starter are connected in series to one another, so that the latter are switched in only when all engaging relays have closed one switch on the engaging relay. According to one preferred specific embodiment, the switching relays are each able to be switched off individually by the control relay in the respective starter.

The object is also attained by one example method in that the switching relay is switched off as a function of a specified event. The specified event is established previously on the part of the manufacturer or the operation, and may be implemented either electromechanically or electronically, for instance, by detecting a certain sensor value, using a sensor.

For this purpose, a computer program product may be provided, for example, which is loaded, having program commands, into a program memory of a control system, and carries out the example method described herein when the program is run in the control system. A computer program product has the advantage that it may be implemented as a module in control systems that are already present, and that it is easy to adapt to individual and application-specific specifications, a correction of empirically ascertained values being very easily possible.

According to one especially simple and stable method, the switching relay is switched off simultaneously with the engaging relay by the control relay. An electromechanical control has the advantage that a long service life is able to be implemented having a high failure safety.

According to one alternative specific embodiment, which may be developed either electronically or electromechanically, the switching relay is switched off in a manner set in time and/or established before the engaging relay. An electronically or an electromechanically set time delay element may be provided, for example, in order to specify a defined time difference between this switching off of the switching relay and the engaging relay in the switching-off process, in order to avoid so-called pinion bounces, that is, a re-engaging motion after the disengaging of a starter pinion.

According to one preferred method, the switching relay is only switched in if the control relay and the engaging relay are closed. This avoids that the starter motor is energized too early. Furthermore, it is thus possible, according to the present invention, to interrupt the current for the starter motor only by the control relay.

In order to start an internal combustion engine in a preferred specific embodiment having starters that are situated in parallel, in response to a plurality of starts, the respective switching relays for the respective starter motor are switched in only when all engaging relays, and particularly all control relays have closed switches. It is consequently ensured that each individual starter is not overloaded and all starters start the internal combustion engine simultaneously with great certainty within a small tolerance range.

According to one specific embodiment refining the present invention, the starters are developed in a starter system having a switching system described above, which carries out the method described above, in such a way that the engaging relay is developed as a single-stage relay. that is, it has only one winding. Single-stage relays are used for small internal combustion engines. A required rotating motion of the starter pinion takes place, for instance, via a coarse thread in the starter.

The engaging relay is preferably developed two-staged in a starter system having a plurality of starters, having a pull-in winding and an hold-in winding. The pull-in winding is connected in the current path of the switch motor, so that during engaging, the starter motor is turned on slightly, in order to avoid a tooth-on-tooth position to the greatest extent possible, so that a tooth-gap setting is produced with great certainty between the ring gear and the starter pinion.

It is understood that the aforementioned features, which will be discussed below, are able to be used not only in the individually indicated combination, but also in other combinations.

BRIEF DESCRIPTION OF THE DRAWINGS

The present invention is explained in greater detail below, with reference to the figures.

DETAILED DESCRIPTION OF EXAMPLE EMBODIMENTS

Figure 1:
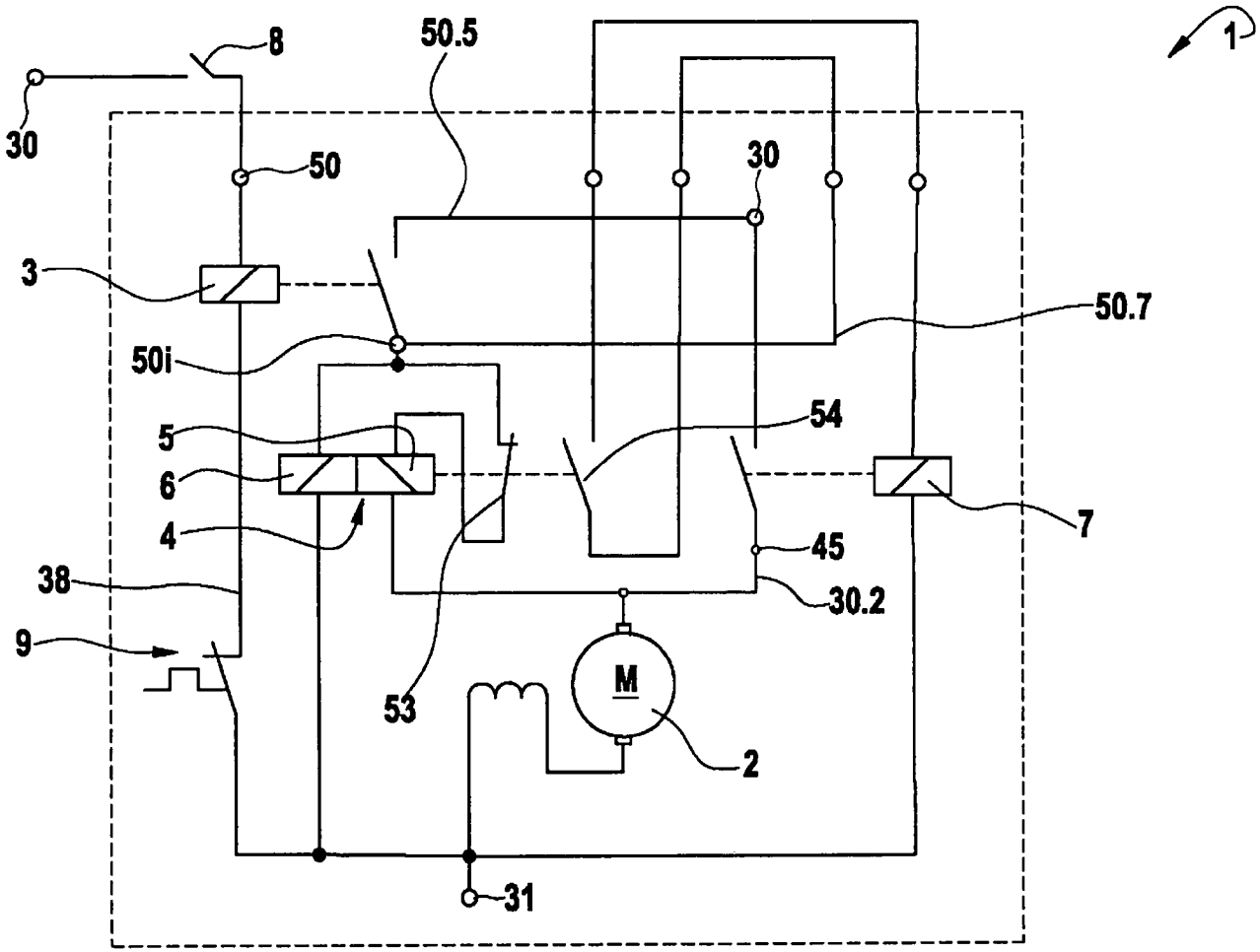
FIG. 1 shows a schematic circuit diagram of a circuit configuration of an example starter according to the present invention.
Figure 2:
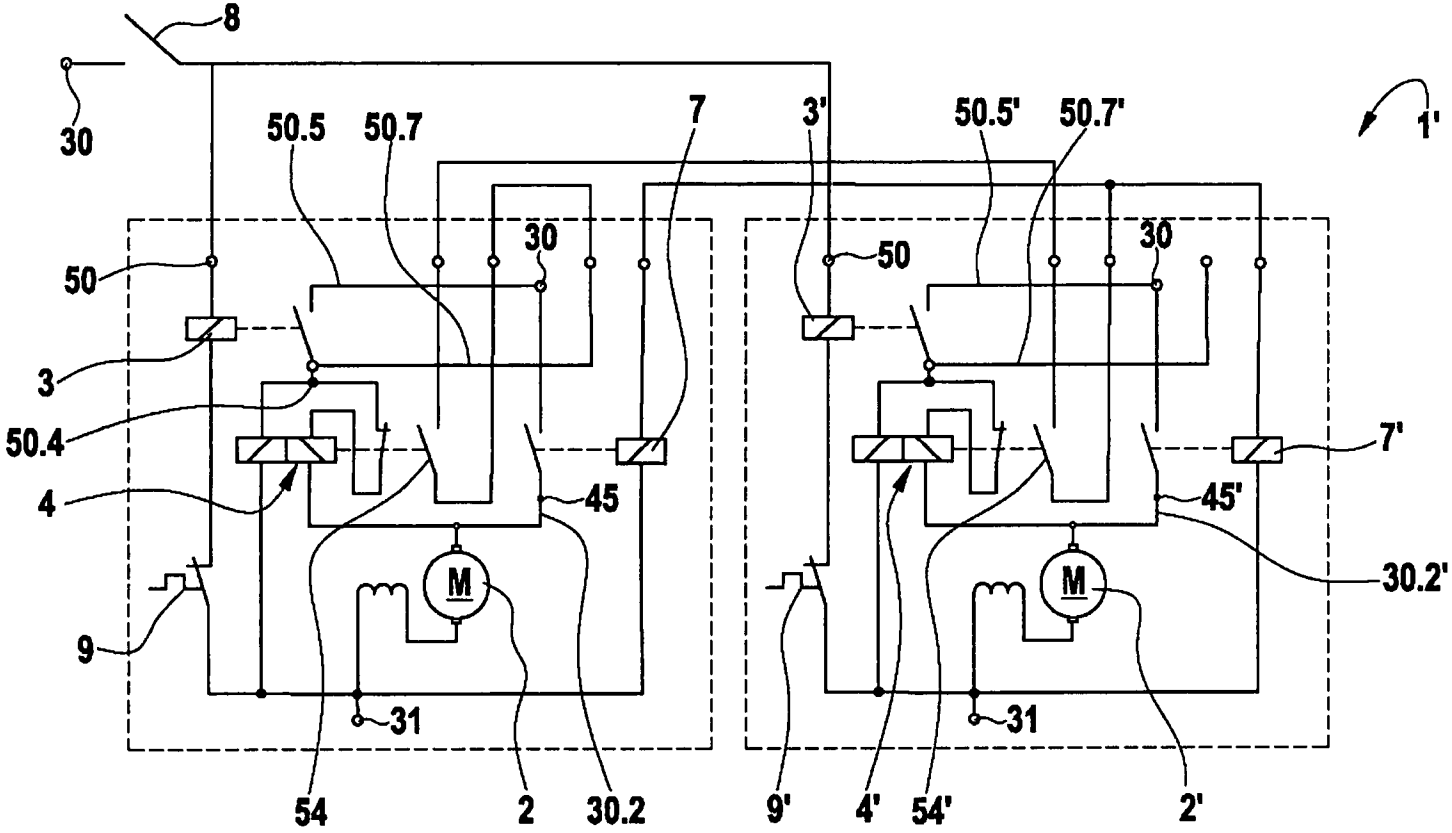
FIG. 2 shows a schematic circuit configuration having two starters.

FIG. 1 shows a schematic circuit diagram of a circuit configuration for starting an internal combustion engine using a starter 1 which, as shown in FIG. 2, may be connected and situated parallel to a second one. Starter 1 includes a starter motor 2 and a control relay 3, which is situated in an ignition path 38 having a mechanically or electronically controlled ignition switch 8. In order to engage a starter pinion (not shown) in the ring gear of an internal combustion engine (not shown), an engaging relay 4 is provided. Engaging relay 4 has an engaging winding 5 and a hold-in winding 6. Engaging winding 5 is highly resistive, so that starter motor 2 experiences a small starting current, in order to avoid a tooth-on-tooth position of starting pinion and ring gear during the engaging process. Once engaging relay 4 is engaged, engaging winding 5 is switched off by a mechanically connected switch 53, and engaging relay 4 is held in an engaged state using a small current. When the maximum engaging depth is reached, engaging relay 4 closes a switch 54, so that switching relay 7 is energized, and is able to start the internal combustion engine with a maximum current. The positive pole of the battery is designated as terminal 30, and the grounding as terminal 31. An ignition switch 8 is situated between the battery's positive pole, terminal 30 and a starter control terminal 50.

According to one preferred specific embodiment, switching relay 7 is connected to a second control switch, in order, in the disengaging process of the starter pinion, to avoid the latter's potential motion back in the direction of the ring gear. This second control switch is preferably controlled as a function of the appearance of a certain, specified event. The specified event is "freely" selectable. The event may be perceived using a detector or using a switch. To achieve a light electromechanical design, as is shown in FIG. 1, switching relay 7 is preferably situated in a current path 50.5, that is switchable by control relay 3 of engaging relay 4.

Consequently, switching relay 7, which at a terminal 45 switches through the main current for starter motor 2, is able to be switched off clearly earlier in time than in a circuit configuration or starter control known from the related art, so that pinion bounces are avoided, and thus wear on the ring gear or on the tooth faces of the starter pinion or on one of the two toothed wheels is clearly reduced or avoided. Because of this electromechanical circuit diagram, the switching off of switching relay 7 is a function of an event in an exactly defined manner. Consequently, engaging relay 4 is switched off simultaneously with switching relay 7 by control relay 3.

To protect starter 1 from thermal overloading, a thermal switch 9 is connected in series with control relay 3 in starter 1. Thus, thermal switch 9 produces the same switch-off behavior as opening ignition switch 8.

FIG. 2 shows two starters 1 and 1' situated in parallel, each having one starter motor 2, 2' for starting internal combustion engines having large displacement, such as commercial vehicles or ship engines. Each starter 1, 1' has a separate control relay 3, 3', which is controlled by ignition switch 8. The passing on of the control signals by ignition switch 8 takes place by internal wiring. Control relay 3, 3' then switches an engaging relay 4, 4', respectively. Engaging relays 4, 4' may each have different engaging times, since, for instance, in starter 1 a tooth-on-tooth position is present and the starter pinion using starter motor 2 is slightly energized by a highly resistive engaging winding 5. On starter 1' there is possibly immediately present a tooth-gap setting between the starter pinion and the ring gear, so that, in this case, the engaging process clearly takes place more rapidly. When the internal combustion engine is started, in order for starter motors 2, 2' to be loaded equally, starters 1, 1' are serially wired, so that switching relays 7, 7' are energized, for switching a main current or a main current path 30.2, 30.2' at terminals 45, 45', by starter motors 2, 2' only when all engaging relays 4, 4' are completely engaged. For this purpose, a switch 54, 54' at engaging relays 4, 4' is closed.

According to the present invention, in current path 50.5 of engaging relay 4, which is switched by control relays 3, 3', a branching is developed of a current path 50.7, 50.7' that contacts switch 54, 54'. Consequently, switching relays 7, 7' are energized only when both switches 54, 54' and the switch of control relays 3, 3' are closed. Consequently, a new function is achieved in the switching-off process. If control relay 3, 3' is switched off by not having current applied to it, then, switching relay 7, 7' is switched off together with engaging relay 4, 4' at the same time, by not having current applied.

As was described in connection with FIG. 1, each starter 1, 1', in series with control relay 3, 3', respectively includes a thermal switch 9, 9' as overload protection.

Figure 3:
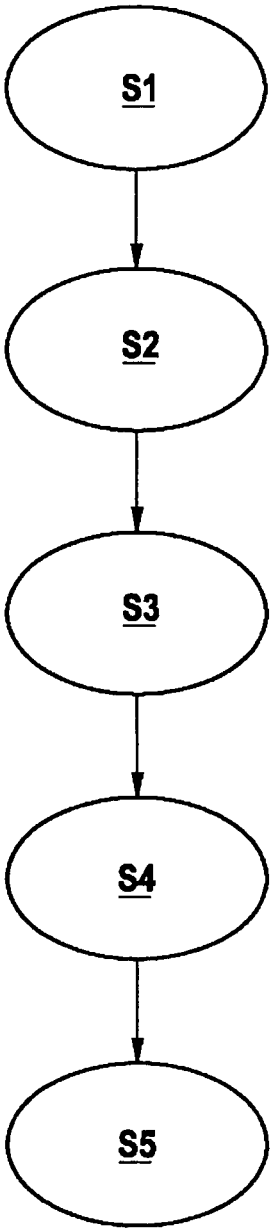
FIG. 3 shows a schematic flow chart according to the example method of the present invention.

In order to clarify the functional linkage between the three relays 2, 4 and 7, which could also be implemented by an electronic control using a computer program product, FIG. 3 shows a schematic flow chart of a disengaging process of starters.

To engage, ignition switch 8 is first closed, so that control relay 3 closes, and after that, engaging relay 4 closes, which operates switch 54, so that switching relay 7 releases the main current for starter motor 2. When starter 1 is switched off, the individual relays are operated in the same sequence as during switching on.

At a certain time, when the internal combustion engine has been started, in step S1 an ignition current path 38 is opened by ignition switch 8.

In step S2, in sequence, the electromechanical switch in control relay 3 is opened, so that current path 50.5 no longer directly contacts the battery positive pole, terminal 30.

If current path 50.7, in which switching relay 7, 7' is connected, is no longer energized, then in step S3 starter motor 2 is switched off. At a load terminal 50*i* there is located a current path 50.4, that is switchable by control relay 3, of engaging relay 4, by which, in particular, hold-in winding 6 is energized.

By the opening of control relay 3, engaging relay 4 is also no longer energized, so that in step S4 engaging relay 4 disengages.

Since a current path 30.2 at terminal 45 is already is already interrupted by switching relay 7, engaging winding 5 can no longer be energized, particularly in reverse, so that the starter pinion (not shown) is no longer so markedly moved again against the ring gear as in the starter according to the related art. So-called pinion bounces are more clearly avoided and the switching-off process ends in step S5.

Figure 4:
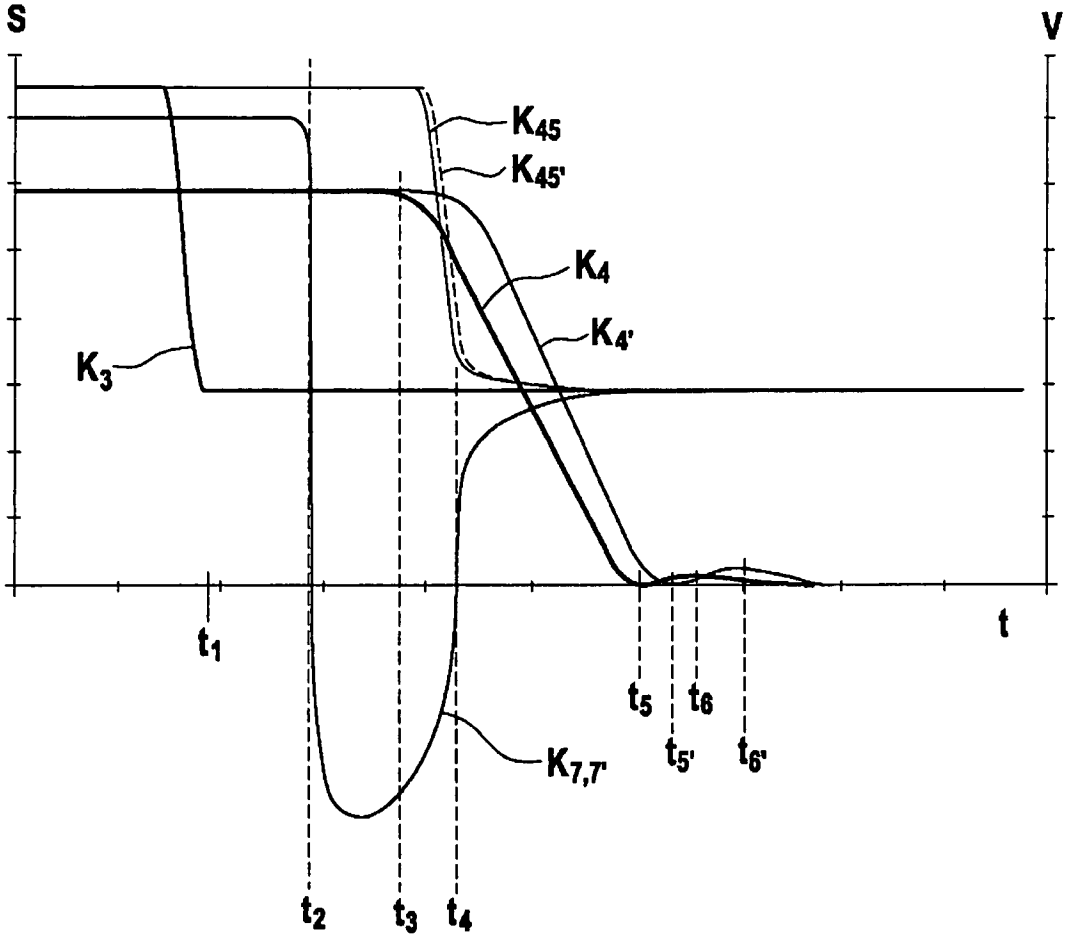
FIG. 4 shows a time-distance-voltage diagram of two starters situated in parallel.

FIG. 4, in a time-distance-voltage diagram, shows the curve over time of a switching-off process, as it was described for FIGS. 1 through 3. Disengaging path S of the starter pinion of starter 1 and 1' is shown using characteristic curves K4 and K4'. Characteristic curve K3 as voltage V-time characteristic curve shows the control signal at control relays 3, 3', the voltage characteristic curve K7, K7' shows the switching signal of switching relays 7, 7' in current path 50.7, and voltage characteristic curves K45, K45' in turn show the delayed characteristic curves of current paths 30.2, 30.2' at terminals 45. 45'.

At a time $t_1$, switching relay 3 is switched off by ignition switch 8. Based on the delayed switching time of control relay 3, at time $t_2$, current path 50.7, 50.7' according to characteristic curve K7, K7' becomes deenergized, or rather, as shown in FIG. 4, experiences a negative voltage. Similarly delayed in time, at time $t_3$, the starter pinions are disengaged corresponding to characteristic curves K4 and K4' over distance S. In a very short distance in time to time $t_4$, current paths 30.2, 30.2' become deenergized corresponding to characteristic curves K45, K45'. Consequently, main current paths 30.2, 30.2' are time-wise clearly deenergized before time $t_5$, at which the starter pinions are in a disengaged state. The second starter pinion is time-wise disengaged somewhat delayed at time $t_{5'}$. At time $t_6$, $t_{6'}$ the starter pinions execute quite a minimal reverse motion based on a primarily mechanically produced pulse. Reverse energizing of engaging winding 5 of engaging relay 4 no longer occurs, according to the present invention.

In FIG. 4, one may see that the main current in current paths 30.2, 30.2' at time $t_5$ is already switched off before the engaging pinions are completely disengaged. Consequently, pinion bounces have been very well avoided and wear is therefore clearly reduced, or completely excluded. The formation of sparks is not possible.

Figure 5:
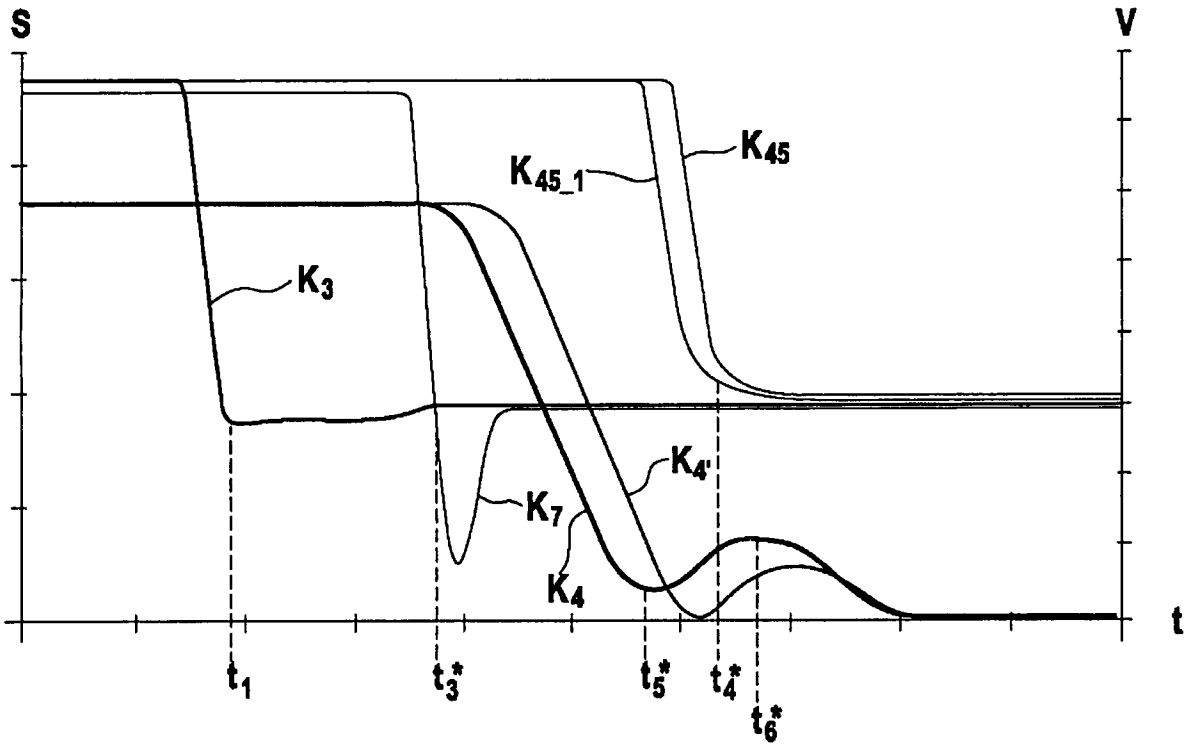
FIG. 5 shows a time-distance-voltage diagram of two starters situated in parallel having pronounced pinion bounces.

By contrast, FIG. 5 shows the case, for instance, when the switching off of relay 7, 7' takes place later in time than in FIG. 4, because of an electronic control or because of a circuit configuration according to the abovementioned related art. As is shown in FIG. 4, at time $t_1$ in the ignition current path, control relay 3 is switched off according to characteristic curve K3. Based on the electromechanical effect of control relay 3 and of engaging relay 4, at time $t_{3*}$ current path 50.7, 50.7' is switched to being deenergized simultaneously with the disengaging process of the starter pinions at engaging relays 4. Based on the time-wise electromechanical delay, in turn, at time $t_{5*}$ the starter pinions are disengaged, which occurs time-wise before time $t_4$. At time $t_{4*}$, current path 30.2 is deenergized. Since this time is after the time according to FIG. 4, engaging winding 5 is briefly energized in reverse, so that, as shown in the diagram by distance characteristic curves K4, K4', a clear reverse motion takes place on the starter pinions in the direction of the ring gear, which could possibly lead to undesirable wear. According to the present invention, it is therefore provided that time $t_{4*}$ be shifted forwards, individually adjustable in time. Doing this will avoid pronounced pinion bounces, as are able to occur, for example, at time $t_{6*}$. All the figures show only schematic illustrations which are not to scale.

What is claimed is:

1. A circuit configuration for starting an internal combustion engine, comprising:

a starter including a starter motor, an engaging relay, a switching relay, and a control relay able to be controlled by an ignition switch, the engaging relay being able to be controlled by the control relay and a current path of the starter motor being able to be switched using the switching relay;

wherein the switching relay is able to be controlled as a function of an occurrence of a specified event, at least in a switching-off process of the starter;

wherein a winding of the switching relay is situated in a current path that is able to be switched by the control relay, wherein the current path is a conductive line, wherein a first end of the conductive line is connected directly to the winding of the switching relay, wherein a second end of the conductive line is connected directly to a switch controlled by the control relay, and wherein the current path is closed when a switch controlled by the engaging relay is closed.

2. The circuit configuration as recited in claim 1, wherein the specified event is established by an electromechanically developed circuit configuration.

3. The circuit configuration as recited in claim 1, wherein the engaging relay has two control switches.

4. The circuit configuration as recited in claim 1, wherein the circuit configuration is an electronic control having electronic power switches by which a specified event is able to be established for switching off.

5. The circuit configuration as recited in claim 1, wherein the circuit configuration comprised a plurality of the starters for starting the internal combustion engine, the starters being connected and situated in parallel.

6. The circuit configuration as recited in claim 1, wherein:

the engaging relay is connected directly to the switch controlled by the control relay, so that an opening of the switch controlled by the control relay simultaneously switches off the engaging relay and the winding of the switching relay.

7. The circuit configuration as recited in claim 1, further comprising a thermal switch having a terminal connected in series to a winding of the control relay.

8. The circuit configuration as recited in claim 7, wherein the thermal switch and the winding of the control relay are connected in series to the ignition switch.

9. A method of a starter control of a circuit configuration, including a starter, the starter including a starter motor, a control relay, an engaging relay and a switching relay, the engaging relay being controlled by the control relay and the switching relay being controlled as a function of a specified event by the engaging relay, the method comprising:

controlling the switching relay as a function of an occurrence of a specified event, at least in a switching-off process of the starter; and switching, by the control relay, a current path on which a winding of the switching relay is situated, wherein the current path is a conductive line, wherein a first end of the conductive line is connected directly to the winding of the switching relay, wherein a second end of the conductive line is connected directly to a switch controlled by the control relay, wherein, when the switch of the control relay is closed, the switching includes permitting current to flow between the switch of the control relay and the winding of the switching relay, wherein, when the switch of the control relay is opened, the switching includes de-energizing the winding of the switching relay, and wherein the current path is closed when a switch controlled by the engaging relay is closed.

10. The method as recited in claim 9, wherein the switching relay is switched off at least one of adjustable in time and at a set time, before engaging relay.

11. The method as recited in claim 9, wherein the switching relay is switched on only if the control relay and the engaging relay are closed.

12. The method as recited claim 9, wherein the circuit includes a plurality of the starters, the respective switching relays being switched on only when all the control relays are closed.

13. The method as recited in claim 9, wherein:

the engaging relay is connected directly to the switch controlled by the control relay, so that an opening of the switch controlled by the control relay simultaneously switches off the engaging relay and the winding of the switching relay.

* * * * *